US008946993B2

(12) United States Patent
Murnick et al.

(10) Patent No.: US 8,946,993 B2
(45) Date of Patent: Feb. 3, 2015

(54) FLUORESCENT EXCIMER LAMPS

(75) Inventors: Daniel E. Murnick, Bernardsville, NJ (US); Nazieh Mohammad Masoud, Brookfield, WI (US); Richard Riman, Belle Mead, NJ (US)

(73) Assignee: Rutgers, The State University, New Brunswick, NJ (US)

( * ) Notice: Subject to any disclaimer, the term of this patent is extended or adjusted under 35 U.S.C. 154(b) by 988 days.

(21) Appl. No.: 12/992,185

(22) PCT Filed: May 15, 2009

(86) PCT No.: PCT/US2009/003039

§ 371 (c)(1),
(2), (4) Date: Mar. 25, 2011

(87) PCT Pub. No.: WO2009/139908

PCT Pub. Date: Nov. 19, 2009

(65) Prior Publication Data

US 2011/0254449 A1 Oct. 20, 2011

Related U.S. Application Data

(60) Provisional application No. 61/127,676, filed on May 15, 2008.

(51) Int. Cl.

| | |
|---|---|
| ***H05B 31/26*** | (2006.01) |
| ***H01J 63/04*** | (2006.01) |
| ***H01J 63/02*** | (2006.01) |
| ***H01J 63/08*** | (2006.01) |

(52) U.S. Cl.

CPC ..... *H01J 63/02* (2013.01); *H01J 63/04* (2013.01); *H01J 63/08* (2013.01)

USPC ..... 315/111.81; 313/486; 315/39

(58) Field of Classification Search

USPC ..... 315/39; 313/486

See application file for complete search history.

(56) References Cited

U.S. PATENT DOCUMENTS

| | | | | |
|---|---|---|---|---|
| 5,604,410 | A * | 2/1997 | Vollkommer et al. | 315/246 |
| 6,052,401 | A * | 4/2000 | Wieser et al. | 372/74 |
| 6,259,214 | B1 * | 7/2001 | Doell et al. | 315/246 |
| 6,400,089 | B1 * | 6/2002 | Salvermoser et al. | 315/111.81 |

(Continued)

OTHER PUBLICATIONS

Ronda, "Luminescent materials with quantum efficiency larger than 1, status and prospects," Journal of Luminescense 100 (2002) 301-305.

(Continued)

*Primary Examiner* — Tung X Le
*Assistant Examiner* — Jonathan Cooper
(74) *Attorney, Agent, or Firm* — Lerner, David, Littenberg, Krumholz & Mentlik, LLP

(57) ABSTRACT

Excimers are formed in a high pressure gas by applying a potential between a first electrode (14, 214) and a counter electrode (25, 226) so as to impose an electric field within the gas, or by introducing high energy electrons into the gas using an electron beam. A phosphor for converting the wavelength of radiation emitted from the formed excimers is disposed within the gas and outside a region (62, 162) where the excimers are expected to be formed, so as to avoid degradation of the phosphor.

22 Claims, 6 Drawing Sheets

(56) References Cited

U.S. PATENT DOCUMENTS

| | | | | |
|---|---|---|---|---|
| 6,507,031 | B1 | 1/2003 | Jinbo et al. | |
| 6,777,878 | B2 * | 8/2004 | Berlinghof et al. | 315/58 |
| 7,223,482 | B2 | 5/2007 | Do et al. | |
| 2002/0121856 | A1 * | 9/2002 | Tsai | 313/491 |
| 2003/0143356 | A1 | 7/2003 | Morikawa | |
| 2004/0173378 | A1 | 9/2004 | Zhou et al. | |
| 2005/0001533 | A1 * | 1/2005 | Huber et al. | 313/485 |
| 2005/0168124 | A1 | 8/2005 | Justel et al. | |
| 2006/0054821 | A1 | 3/2006 | Salvermoser et al. | |
| 2007/0090740 | A1 * | 4/2007 | Hiraoka et al. | 313/234 |

OTHER PUBLICATIONS

Zhang, "Vacuum-Ultravoilet/Visible Conversion Phosphors for Plasma Display Panels," IEEE Transactions on Plasma Science (2006) 1-11.

Jüstel et al., "Temperature-dependent spectra of YPO4:Me(Me = Ce, Pr, Nd, Bi)," Journal of Luminescence 106 (2004) 225-233.

Feldman et al., "Quantum efficiency of down-conversion of phosphor LiGdF4:Eu," Journal of Luminescence 92 (2001) 245-254.

International Search Report, PCT/US2009/03039, dated Jun. 24, 2009.

* cited by examiner

FLUORESCENT EXCIMER LAMPS

CROSS-REFERENCE TO RELATED APPLICATIONS

This application is a national phase entry under 35 U.S.C. §371 of International Application No. PCT/US2009/003039, filed May 15, 2009, published in English, which claims the benefit of U.S. Provisional Patent Application No. 61/127,676 filed May 15, 2008, the disclosures of which are hereby incorporated herein by reference.

FIELD OF THE INVENTION

This present invention relates to excimer lamps including an electron source, such as a corona discharge or electric field emission lamp or an electron beam excited lamp and, in particular, excimer lamps including phosphors.

BACKGROUND OF THE INVENTION

Excimer lamps are capable of generating ultraviolet ("UV") radiation with very high efficiency. For example, excimer lamps can generate radiation in the spectral region of between about 50 and 200 nanometers wavelength, commonly known as vacuum ultraviolet or "VUV" radiation, with high efficiency. In certain applications, for example, general lighting, apparatus for reducing contaminants in a fluid stream, such as exhaust gases of a combustion engine and apparatus for germicidal use, it is desirable to convert the VUV radiation generated by such light sources to visible or longer wavelength UV radiation. Suitable phosphors are used in connection with such lamps to obtain the desired longer wavelength UV radiation.

A known light source for generating UV and VUV radiation is a mercury low pressure discharge lamp. A mercury discharge lamp, however, may be undesirable for many applications, because, if the lamp were to break, the mercury may be released, which may harm the environment as well as the components of an apparatus, such as a catalytic converter of automobile, in which the mercury lamp is included. In addition, mercury or other reactive chemicals in a mercury discharge lamp may degrade phosphors, such that mercury lamps that include phosphor for converting VUV radiation to longer wavelengths have a limited lifetime. The common general lighting fluorescent lamp incorporates phosphors to convert 254 nm wavelength UV radiation generated from the mercury to visible light.

One type of excimer lamp for generating VUV radiation is a dielectric barrier discharge ("DBD") excimer lamp. The DBD excimer lamp typically includes a pair of electrodes coated with a dielectric and separated by a gas for producing excimer emissions, for example, noble gases, all of which are contained within a discharge tube or vessel. When it is desired that a DBD lamp produce radiation emissions in the visible or near UV spectral range, the dielectric barrier is coated with phosphor. DBD excimer lamps, however, generate a substantial amount of heat and also short wavelength radiation, each of which may cause degradation of phosphor. Also, DBD excimer lamps generate high energy ions or electrons that may bombard the phosphor in the lamp, which would result in degradation of the phosphor.

Another known excimer discharge lamp generates VUV radiation based on application of an electric field to a gas capable of forming excimers and providing free electrons in the gas. See U.S. Pat. No. 6,400,089, incorporated by reference herein. In such lamps, which are commonly known as corona discharge lamps, the electric field is typically configured to accelerate electrons between a first electrode and a counter electrode to at least the energy required to form excimers, but is configured so that in at least one region of the field, the field strength is below that required to substantially ionize the gas. It is also known to pulse the potential applied between the two electrodes in such excimer lamps for creating the electric field, so as to improve the efficiency of the lamp, while substantially avoiding harmful arcing within the discharge vessel. See U.S. Pat. No. 7,199,374 ("the '374 Patent"), incorporated by reference herein. When phosphor is included within the electric field region of such excimer lamps to produce longer wavelength radiation, however, the phosphor may degrade.

Also known is an electrodeless excimer lamp, which generates VUV radiation based on introduction of energetic electrons into a gas capable of forming excimers, so as to provide energetic free electrons in the gas. See U.S. Pat. No. 6,052,401 ("the '401 Patent"), incorporated by reference herein. In such lamps, which are commonly known as electron beam pumped lamps, high energy electrons, typically 10 to 20 kev, are injected through a thin ceramic membrane into the excimer forming gas. With this type of lamp as well, when a phosphor is included within the lamp to produce longer wavelength radiation, the phosphor may degrade.

Although coatings have been applied to a phosphors contained within devices such as plasma display panels for protecting the phosphor from degradation based on high energy ion or electron bombardment, see U.S. Pat. No. 7,223,482, the use of such coatings lowers the efficiencies such devices.

Therefore, there exists a need for a lamp for efficiently generating VUV radiation and converting the VUV radiation to longer wavelength radiation using phosphor, while avoiding degradation of the phosphor.

SUMMARY OF THE INVENTION

One aspect of the invention provides methods of generating light. The method according to this aspect of the invention desirably comprises forming excimers within a chamber containing an excimer-forming gas and a phosphor by providing energetic free electrons within the gas, so that the excimers produce radiation and the radiation impinges on the phosphor. Most preferably, the phosphor is within the gas and outside of a region of the chamber where a substantial majority of free electrons in the gas have energies equal to or greater than the excitation energy required to form the excimers. In certain methods according to this aspect of the invention, the excimers emit vacuum ultraviolet ("VUV") radiation. The phosphor desirably converts the radiation produced by the excimers to light at a wavelength different from a wavelength of the radiation produced by the excimers. For example, the phosphor may convert VUV radiation from the excimers to longer-wavelength UV light or visible light. Because the phosphor is disposed inside the chamber, in contact with the gas, the VUV light can be efficiently transmitted to the phosphor, without any need to pass through a solid barrier. Although the present invention is not limited by any theory of operation, it is believed that because the phosphor is disposed outside of the region where there is a substantial number of highly energetic electrons, the phosphor is protected from degradation caused by such electrons and therefore lasts longer.

The step of forming excimers may include imposing an electric field within the gas by applying an electric potential between a first electrode and a counter electrode remote from the first electrode within the gas, so that free electrons pass from the first electrode toward the counter electrode. Desirably, the electric field is configured so that within at least a part of the field the free electrons have an electron energy distribution such that at least some free electrons have energies equal to or greater than the excitation energy required to form the excimer; and a substantial majority of free electrons have energies less than the ionization energy of the gas. The phosphor desirably is disposed outside of this part of the field, and most preferably is disposed entirely outside of the imposed electric field.

In a further variant, the step of forming excimers may include directing an electron beam into the chamber from outside of the chamber as, for example, through a thin window in the wall of the chamber.

A further aspect of the invention provides light-emitting apparatus. Apparatus according to this aspect of the invention desirably includes a chamber for containing an excimer-forming gas and an electron source associated with the chamber. The electron source is arranged to provide high energy electrons in the gas so that within a region of the chamber a substantial majority of free electrons in the gas have energies equal to or greater than the excitation energy required to form the excimers. The apparatus desirably includes a phosphor disposed within the chamber and outside of said region. The electron source may include, for example electrodes and a potential-applying source for applying a field as discussed above, and the phosphor may be disposed outside of the space between the electrodes. Alternatively, the electron source may include an electron beam gun as discussed above, and the phosphor may be disposed outside of the region where the beam enters the chamber.

BRIEF DESCRIPTION OF THE DRAWINGS

Other objects and advantages of the present invention will be apparent from the following detailed description of the present preferred embodiments, which description should be considered in conjunction with the accompanying drawings in which like reference indicate similar elements and in which.

DETAILED DESCRIPTION

Figure 1:
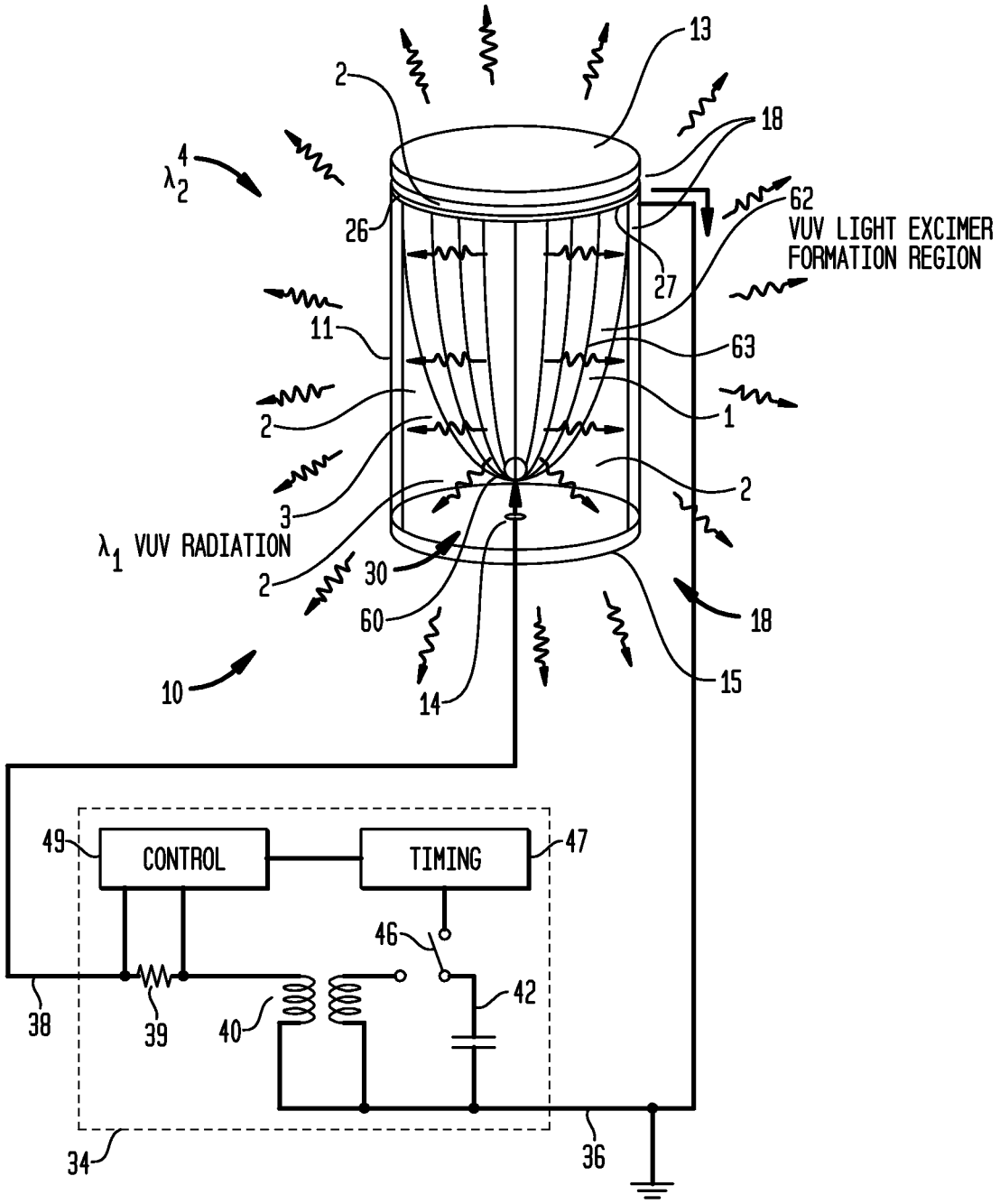
FIG. 1 is an elevational view of an apparatus according to one embodiment of the invention.

Apparatus in accordance with one embodiment of the present invention includes a chamber 10 having a tubular wall 11 formed from a material transparent to the light which will be produced by the phosphor. The light may be, for example, UV light or visible light. The transparent material most preferably is a glass such as fused silica or, borosilicate glass or, for visible light, ordinary soda-lime glass. The chamber also includes end caps 13 and 15. The end caps also may be formed from material transparent to the light emitted by the phosphor. The chamber 10 further includes a first electrode 14 in the form of a wire with a sharp tip disposed at the center of the end cap 15. The chamber is also provided with a flat counter electrode 26 in the form of a metallic ring with a radius r. The tip of the first electrode lies on the central axis of the counter electrode, at a distance d along the axis from the plane of the ring. Thus, the ring or counterelectrode 26 is hence disposed at a uniform distance of $\sqrt{(r^2)+(d^2)}$ from the tip of the first electrode 14. The first electrode 14 may be physically supported by the end cap 15, but is electrically insulated from the end cap 15, and the counter electrode 26 may physically supported by the other end cap 13. The distance, d, between the first electrode 14 and the center of the counter electrode 26 may be, for example, between about 0 cm to 10 cm, and the radius, r, of the counter electrode 26 may be between about 0.5 cm to 5 cm The interior of chamber 10 is filled with an excimer-forming gas 30. Gas 30 desirably is a high-purity gas, such as high-purity Xe, and is at a pressure of about 0.5 atmospheres or above, more preferably about 1 atmosphere or above.

The interior of the chamber 10 further includes a phosphor 18 disposed inside the chamber in contact with the excimer-forming gas. The phosphor 18 is disposed between the inside surface of the tubular wall 11 and the outside of an electric field region, in which excimers are expected to be formed. The phosphor may be in the form of a layer about 1 to 500 microns thick, and may be disposed, for example, on the inside surface of the tubular wall 11 or on a separate element (not shown) disposed inside the chamber. The phosphor 18 most desirably covers the inside of the tubular wall 11 and the inside of the end caps 13 and 15. The phosphor desirably is adapted to convert VUV radiation generated by excimers formed within the chamber 10 to longer wavelength radiation. As discussed below, the phosphor 18 is disposed within the chamber 10 so as to avoid degradation of the phosphor 18 during operation of the apparatus, without adversely impacting the efficiency of the apparatus.

A pulsing power supply 34 is connected to the first electrode 14 and the counter electrode 26. Power supply 34 has a ground connection 36 electrically connected to the counter electrode 26, and has a high-voltage output connection electrically connected to the first electrode 14. The power supply 34 is symbolically shown as incorporating a transformer 40 having a primary side connected to a low-voltage primary circuit 42 through a switching element 46 and having a high-voltage or output side connected to an output connection 38 through a low-value current sensing resistor 39. Although the switching element 46 is depicted as a simple switch, it typically incorporates solid-state switching elements such as transistors, and is controlled by a timing circuit 47 so that the switch periodically closes and opens. When the switch is closed, a magnetic field builds in the transformer. When the switch is opened, the magnetic field suddenly collapses, inducing a high voltage at output connection 38 and hence at the first electrode 14, thereby applying a voltage pulse between the first electrode and the counter electrode 26. A control circuit 49 detects the voltage across sensing resistor 39 and thus detects the current passing through output connection 38 and through first electrode 14. The control circuit is arranged to inhibit operation of timing circuit and thus prevents application of further high-voltage pulses on output connection 38 for a short time such as 0.1-1.0 sec if the current exceeds a pre-selected threshold during a pulse. It should be appreciated that the depiction of the power supply 34 is merely schematic, and that the power supply 34 may include other elements commonly found in conventional high-voltage switching power supplies. The power supply is arranged so that the voltage appearing at output connection 38 is negative with respect to ground.

The power supply and other elements of the circuit connecting the power supply to the electrodes desirably are constructed and arranged to apply a pulse of negative voltage to the first electrode 14 for a duration of about 100 microseconds or less, in the same or similar manner as discussed in detail in the '374 Patent.

Figure 1A:
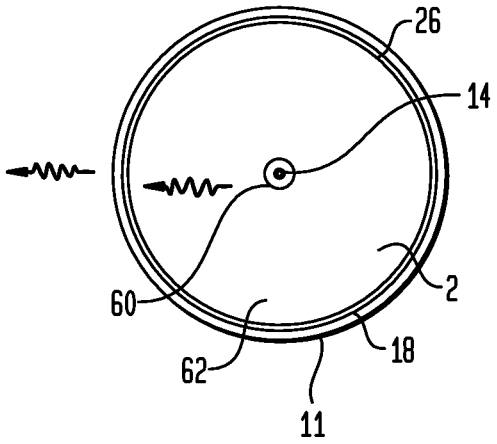
FIG. 1*a* is a sectional view taken along line 1A-1A in FIG. 1.

In operation of the apparatus, when a negative potential is applied to the wire first electrode 14, a high intensity electric field is created around the tip of the first electrode 14 and between the tip of the first electrode and the counter electrode 26. The field strength is highest immediately adjacent the first electrode 14. Referring to FIGS. 1 and 1A, the field strength is highest immediately adjacent the first electrode 14. Within an inner, generally spherical region 60 of the field, which extends from the tip of first electrode 14 to a radial distance $R_{inner}$ from the tip of first electrode 14, the field strength is sufficient to cause appreciable ionization of the gas 30, which yields free electrons. Within this region 60, a substantial proportion of the free electrons have mean energies near to or higher than the ionization energy of the gas, such that a localized corona discharge occurs within the inner region 60. Under the influence of the electric field, free electrons follow electric field lines 1 and move toward the counter electrode 26 and pass out of the inner region 60 to an outer region 62. The outer region 62 extends from and around the inner region 60 to the outer electrode 26, forming a cone that has the tip of the first electrode 14 as the head of the cone, a surface 27 of the counter electrode 26, which faces the tip, as the base of the cone, and an outer surface 63 extending from the tip to the base of the cone.

Within the outer region 62, the field is substantially lower than in the inner region 60, and is nearly uniform. Within region 62, all or almost all of the electrons have energies below that required for ionization, but a significant proportion of the electrons have energies above the electron excitation energy $\epsilon^*$ required for excimer formation. As such, in the outer region 62, the free electrons are accelerated to a mean energy well below the ionization energy $\epsilon^{ion}$ of the gas, so that a substantial preponderance of the electrons has energies below the ionization energy of the gas. Thus, in the region 62, a substantial proportion of the gas atoms are promoted to electronically excited states by energy transferred from the free electrons. These excited atoms form excimers. Thus, substantial excimer formation occurs in this region. The excimers decay and emit radiation as, for example, vacuum ultraviolet ("VUV") radiation. The mechanism of radiation emission may vary with the particular excimer and gas composition. For example, with certain gas compositions, the mechanism of emission may include direct emission by the excimer. With other gas compositions, the mechanism of emission may include energy transfer from the excimer to other species present in the gas, and emission by such other species. Unless otherwise specified, references in this disclosure to energy emission by excimers should be understood as including these and other mechanisms.

As discussed in the '374 Patent, formation of excimers increases with the field strength in the outer region 62, and thus increases with the applied voltage, and the application of pulses potential with relatively short pulse duration avoids arcing and provides for operation at a higher potential and thus higher efficiency.

The outer surface 63 of the outer region 62 defines a boundary of a further region 2. The region 2 includes the volume between the inside of the tubular wall 11 and the outer surface 63 of the envelope of the region 62. The region 2 also includes the volume between the surface 27 of the counter electrode 26 and the end cap window 13. The region 2 further includes the volume between the outer surface 63 of the region 62 and the end cap 15. Stated another way, the electrodes 14 and 26 define a field space between them, and region 2 is outside of the field space.

Within the region 2, no electric field lines exist and, hence, very few or no free electrons with significant energy are present. The region 2 is filled with gas forming excimer atoms and radiated VUV radiation 3.

Referring to FIG. 1, the phosphor 18 is desirably positioned within the chamber 10 in region 2 and hence outside of the field space and outside of regions 60 and 62. Stated another way, the phosphor is disposed within the chamber but outside of a region where a substantial majority of free electrons having energies equal to or greater than the excitation energy required to form the excimers is expected to exist during operation. The phosphor is, therefore, protected from bombardment by high-energy electrons.

However, the phosphor 18 is positioned in the chamber 10 within the region 2, in contact with the excimer-forming gas. Thus, the phosphor 18 is disposed in the pathway of VUV radiation 3 generated by excimers formed within the region 62. Most preferably, the VUV radiation generated by the excimers in region 62 can impinge on the phosphor 18 without passing through a solid wall. The phosphor converts the VUV radiation to longer wavelength radiation 4 as, for example, longer wavelength UV light on the order of 200 nm or longer, or visible light. The light 4 emitted by the phosphor exits the chamber 10.

Power dissipation within the chamber 10 is moderate during normal operation, which avoids degradation of the phosphor due to heat. In potential applications of the inventive apparatus, heat dissipation through the chamber walls to normal room air maintains the chamber 10 at a reasonable temperature, typically less than 50° C., such that degradation of the phosphor 18 is avoided.

The excimers typically emit radiation only at particular wavelengths depending on the gas composition. The excimers typically do not emit substantial amounts of radiation at other, shorter wavelengths which are known to degrade many phosphors.

In another embodiment, the counter electrode 26 is coated at least partially with phosphor material.

In a further embodiment, the phosphor 18 in the apparatus may include a plurality of phosphors, such as a combination of red-emitting, green-emitting and blue-emitting ("RGB") phosphors. Such a combination can yield white light from the converted VUV radiation.

In a further embodiment, the phosphor material is disposed selectively within the region 2, such that some of the VUV radiation emitted by the excimers passes out of the chamber without conversion by the phosphor. In this arrangement, the chamber wall should be formed from a material which is at least partially transmissive to the VUV radiation. For example, fused silica is transparent to 172 nm VUV radiation. In this arrangement, the apparatus produces VUV radiation as well as longer wavelength light from the phosphor.

Figure 2:
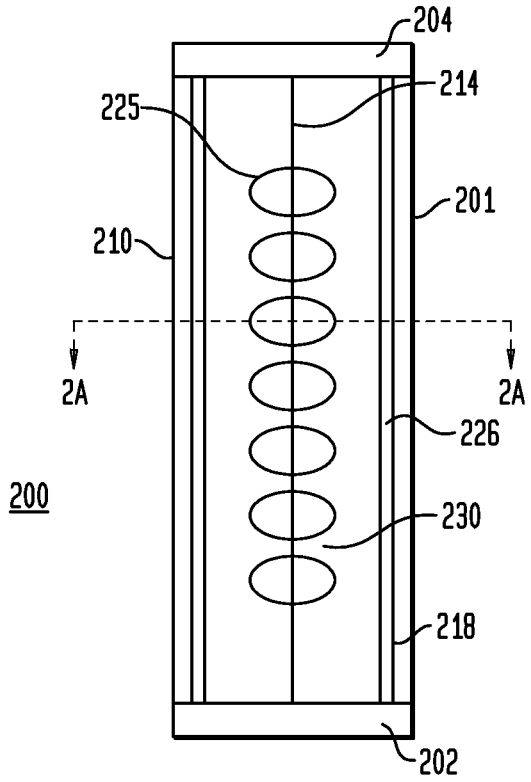
FIG. 2 is a diagrammatic sectional view of an apparatus according to another embodiment of the invention.
Figure 2A:
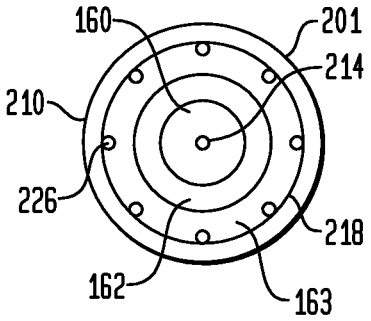
FIG. 2*a* is a sectional view taken along line 2A-2A in FIG. 2.

In a further embodiment of an apparatus 200 according to the present invention, as shown in FIGS. 2 and 2A, the apparatus 200 includes a chamber 210 having a tubular wall 201 whose interior surface is formed from a material, such as fused silica, transparent to the light which will be emitted during operation. The chamber 210 further includes end caps 202 and 204 and contains an excimer forming gas 230, such as described in the '374 Patent. The apparatus 200 further includes a first electrode 214 in the form of an elongated small-diameter metallic wire and a tubular counter electrode 226 in the form of a metallic screen coaxial with the wire first electrode 214 and hence disposed at a uniform distance from the wire first electrode 214. The first wire electrode 214 may be physically supported by the end caps 202 and 204. If the end caps are formed from electrically conductive material, electrode 214 desirably is electrically insulated from the end caps. The counter electrode 226 may be connected to ground potential through one or both of the end caps. A potential application circuit similar to that discussed above is electrically connected between the first electrode 214 and the counter electrode 226, and operated as discussed above.

In operation, when a sufficiently high negative potential is applied to the wire first electrode 214, a set of discrete, cylindrically-shaped light emission zones 225 tends to be produced along the length of the wire 214. The applied potential forms field regions similar to those discussed above with reference to FIG. 1. Thus, referring also to FIG. 2*a*, each emission zone 225 includes an inner region 160 in which a substantial proportion of the electrons have energies above that required for ionization, and an outer region 162 in which all or almost all of the electrons have energies below that required for ionization but many electrons have energy above that required for excimer formation. In this arrangement, the field strength decreases with increasing radial distance from the first or wire electrode 214. Therefore, in an outer region 163 near counter electrode 226, the field strength is below that required for substantial excimer formation. Stated another way, region 163 is a region inside the chamber but outside of a region where a majority of free electrons have energy sufficient for excimer formation. In the illustrated embodiment of the apparatus 200, phosphor 218 is disposed on the inner surface of the chamber wall 201 and hence outside of the field space between electrodes 214 and 226. However, the phosphor may be disposed inside the field space, within region 163. For example, the phosphor can be a coating on the counter electrode 226. In another embodiment, the phosphor 18 can be disposed in region 163, between the counter electrode 226 and the outer region 162. In this arrangement, the phosphor may be supported on a separate structural element (not shown) which is desirably transparent to the light emitted by the phosphor.

Figure 3:
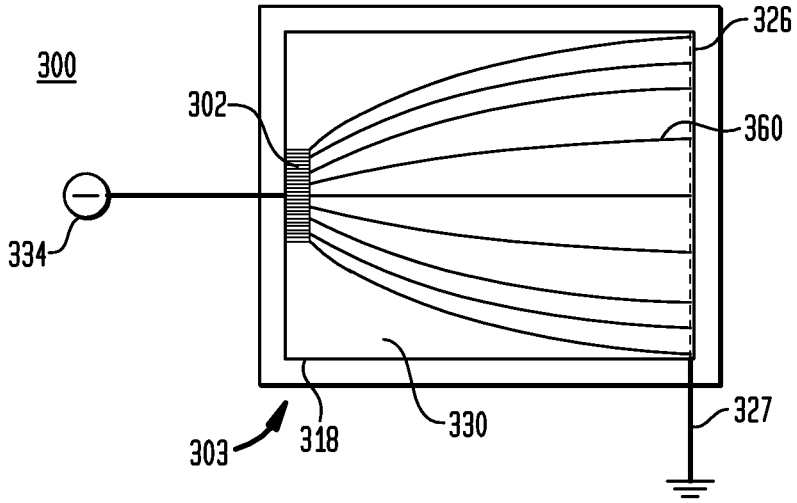
FIG. 3. is a diagrammatic sectional view of an apparatus according to another embodiment of the invention.

In another embodiment of an apparatus according to the present invention, as shown in FIG. 3, a chamber 300 contains an excimer forming gas 330 and includes walls 303 having phosphor 318 on an interior surface thereof. Carbon nanotube electron emitters ("CNTs") 302 are disposed as an electrode at one of the walls 301, and a counter electrode 326 is disposed adjacent or on the inside surface of an opposing wall 301. The CNTs electrode 302 is coupled to a negative potential source 334, and the counter electrode 326 is electrically connected to a ground connection 327.

In operation, when a sufficiently high negative potential is applied by the source 334 to the CNTs electrode 302, a high intensity electric field is created extending from the CNTs electrode 302 to the counter electrode 326. The electric field defines a region 360 of the chamber 300 in which a significant proportion of accelerated free electrons within the gas 330 have energies above the electron excitation energy required for excimer formation, such that excimer formation is expected within the region 360. Phosphor may be desirably disposed within the gas 330 and outside of region 360. Here again, VUV radiation produced by the excimers is converted into longer wavelength radiation, while substantially avoiding degradation of the phosphor. As discussed above, the phosphor may be disposed anywhere in the region defined between the walls 301 and the region 360.

Figure 4:
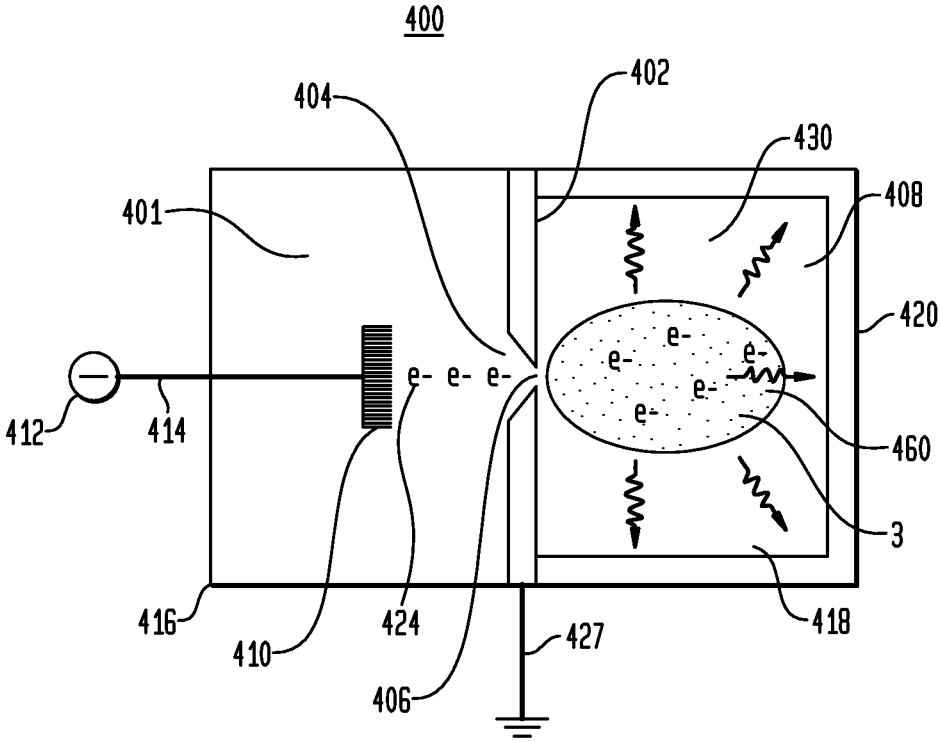
FIG. 4 is a block diagram of an apparatus according to an embodiment of the invention.

In another embodiment of an apparatus in accordance with the present invention, as shown in FIG. 4, an apparatus 400 includes an evacuated electron acceleration chamber 401 having a wall 402. Merely by way of example, the wall 402 may be formed from a silicon substrate. The wall 402 has a hole or window 404 therein and is coated on both sides with $SiN_x$. A foil 406 of $SiN_x$ seals the window 404 so as to form a $SiN_x$ window, such as described in the '401 Patent. The wall 402 in the apparatus 400 separates the chamber 401 from a chamber 408 and is connected to a ground electrode 427. Carbon nanotubes ("CNTs") 410, which are deposited on a metal substrate 410, are within the chamber 401, and connected to a high voltage potential power source 412 by a lead 414, which extends from the CNTs 401, through a wall 416 of the chamber 401 and to the source 412. The chamber 408 is sealed from the interior of the chamber 401 by the film 406. Chamber 408 contains an excimer forming gas 430. The walls of chamber 408 include the wall 402 and film 406 and additional walls 420.

CNTs 410 and wall 402 cooperatively define an electron gun. In operation of the apparatus 400, a sufficiently high negative potential is applied to the CNTs 410 to cause the CNTs 410 to emit electrons. The electrons are accelerated away from CNTs 410 and towards wall 402 by the potential difference between these elements, thus forming an electron beam. Wall 402 tends to develop a charge distribution which focuses the electron beam. The electron beam gun optionally may include other, conventional focusing elements (not shown) such as magnets or focusing electrodes. Thus, the beam of high energy electrons 424 is directed toward the wall 402. The CNTs 410 are disposed in relation to the window 406 in the wall 402, similarly as described in the '401 Patent, such that the beam 424 impinges on and penetrates the foil window 406, and then enters the gas 430 in the chamber 408. Merely by way of example, the electrons in the beam may have energy on the order of 5 to 40 KeV. The electron beam 424 entering the chamber 408 causes the formation of excimers in the gas 430 in a region 460 immediately adjacent to and extending away from the foil window 406. A phosphor material 418 may be disposed within the gas 430 outside of a region where the excimers are expected to be formed, such as outside of the region 460, such that VUV radiation produced by the decaying excimers is converted by the phosphor 418 within the chamber 408 to longer wavelength radiation. In one embodiment, the phosphor 418 is disposed within the chamber 408 on interior surface of the walls 420 and the wall 402.

In the embodiments discussed above, the chamber containing the excimer-forming gas is sealed and hence the excimer-forming gas is permanently retained within the chamber. In other variants, the chamber may be connected to a source of the gas, so that the gas flows through the chamber during operation.

Essentially any excimer-forming gas may be used. Merely by way of example, the excimer-forming gas may include one or more gases selected from the group of helium, neon, argon, krypton, and xenon, commonly referred to as the "noble" gases. The gas may include one or more gases from the aforementioned group and a second gas different from the first gas. Such a second gas is preferably a halogen or halogen compound. Such second gas is more preferably fluorine or fluorine compound. For example, mixtures of one or more noble gases and a halogen-containing gas can be used to form noble gas-halogen excimers. For example, a mixture of argon and helium with fluorine can be excited to from ArF* excimers. For example, Xe as an excimer-forming gas yields VUV radiation at about 172 nm wavelength, whereas Kr yields VUV radiation at about 148 nm wavelength. VUV radiation at these wavelengths can be used to excite a phosphor which yields visible light or longer-wavelength UV radiation, such as radiation in the germicidal UVC region.

The phosphor should be responsive to the radiation from the particular excimers, and should be substantially non-reactive with the gas in the chamber. Merely by way of example, the phosphor may be red- emitting(Y Gd)$BO_3$: Eu3+, green-emitting Zn2SiO4: Mn2+, or blue-emitting $BaMgAl_{10}O_{17}$: Eu2+ (BAM) as are widely being used in plasma display panels (PDPs), or combinations of these. Also, new rare-earth activated lanthanide phosphate phosphors can be employed alone or in combination with other phosphors. Also of use are the $YPO_4$:Me phosphors where Me is a metal dopant selected from the group consisting of Ce; Pr, Nd, and Bi. Some of these phosphors emit in the germicidal UVC region, typically at about 250 nm wavelength. Of particular interest are 2 photon phosphors in which each short wavelength VUV photon is converted to two longer wavelength photons such as has been demonstrated with $LiGdF_4$:Eu. Combinations of these phosphors can be used. Numerous other phosphors and combinations of phosphors can be used.

EXAMPLES

Example 1

Figure 5:
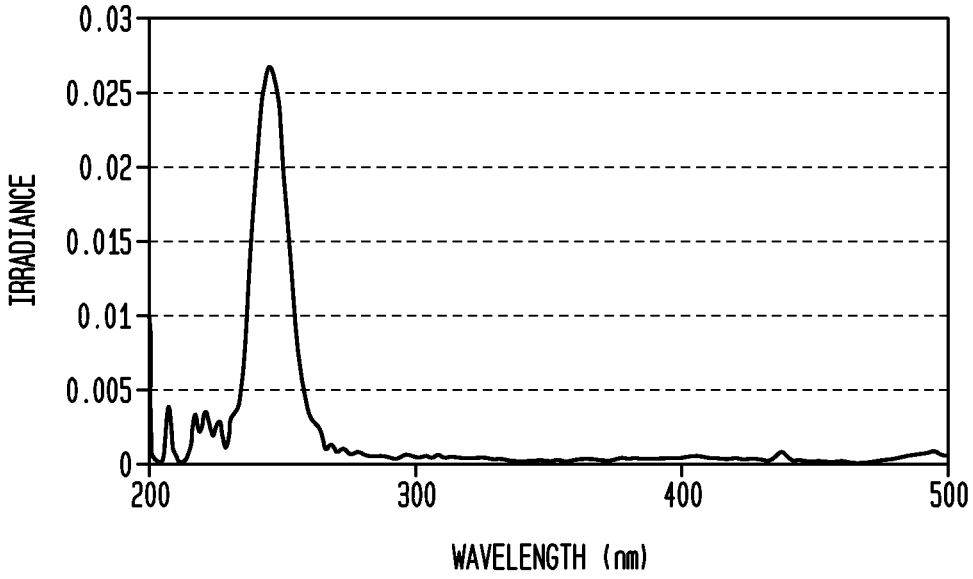
FIG. 5 is a graph illustrating a spectrum of emission from apparatus according to one embodiment of the invention.

A cylindrical germicidal fluorescent lamp was fabricated substantially as depicted in FIGS. 2 and 2A. The chamber was formed from a quartz tube. The interior surface of the tubing was coated with YPO4:Bi phosphor of the type described in the paper Temperature-Dependent Spectra of YPO4:Me (Me ¼ Ce; Pr, Nd, Bi), T. Jüstel, P. Huppertz, W. Mayr, D.U. Wiechert, Journal of Luminescence 106 (2004) 225-233. A wire mesh counter electrode was positioned inside of the phosphor-coated tube, and a wire electrode was provided adjacent the center of the tube. The tube was filled with Xe. In operation, the phosphor emitted light with a power density of tens of mW/cm. The emitted light had a spectrum obtained as shown in FIG. 5, closely matching the spectrum reported in the literature. The emitted light had a substantial component at about 250 nm wavelength, in the germicidal UVC range. The lamp was operated continuously for several months without observable decrease in emission. The lamp thus provides a mercury-free germicidal lamp.

Example 2

A commercial "cool white" fluorescent lamp is disassembled and the mercury-containing gas and electrode structure is removed, leaving a glass tube with the ordinary white-emitting phosphor mix. The tube is assembled with an electrode and counter electrode generally as shown in FIGS. 2 and 2A, and filled with Xe. Upon excitation, the Xe excimers produce 172 nm VUV radiation which impinges on the phosphor. The lamp yielded white light with a luminous efficacy of 90 lumens/watt, considerably better than that of conventional compact fluorescent lamps containing mercury.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be used without departing from the spirit and scope of the present invention as defined by the appended claims.

The invention claimed is:

1. A method of generating light comprising:

forming excimers within a chamber containing an excimer-forming gas and a phosphor by providing energetic free electrons within the gas, so that the excimers produce radiation and the radiation impinges on the phosphor, the step of providing energetic free electrons within the gas being performed so that in a region of the chamber a substantial majority of free electrons in the gas have energies equal to or greater than the excitation energy required to form the excimers and in a further region of the chamber few or no free electrons with energy equal to or greater than said excitation energy are present, wherein the phosphor is within the gas and within the further region of the chamber.

2. The method of claim 1, wherein the excimers emit vacuum ultraviolet ("VUV") radiation.

3. The method of claim 1 wherein the phosphor converts the radiation produced by the excimers to light at a wavelength different from a wavelength of the radiation produced by the excimers.

4. The method of claim 3 further comprising transmitting at least part of the light through a wall of the chamber.

5. The method of claim 1, wherein the gas includes a first gas component selected from the group consisting of He, Ne, Ar, Kr, and Xe and mixtures thereof.

6. The method of claim 1 wherein the chamber is sealed, the method further comprising:

containing said gas inside the sealed chamber.

7. The method of claim 1 wherein the step of providing energetic free electrons within the gas includes:

imposing an electric field within the gas by applying an electric potential between a first electrode in contact with the gas and a counter electrode in contact with the gas remote from the first electrode, so that free electrons pass toward said counter electrode, wherein said electric field is configured so that within at least a part of said field said free electrons have an electron energy distribution such that at least some free electrons have energies equal to or greater than the excitation energy required to form the excimer and a substantial majority of free electrons have energies less than the ionization energy of the gas, whereby said free electrons excite the gas and form excimers without causing arcing, and the phosphor is disposed outside of within the chamber and within the gas but outside of the imposed electric field.

8. The method of claim 7, wherein the electric potential is pulsed and includes pulses about 100 microseconds or less in duration.

9. The method as claimed in claim 1 wherein the step of providing energetic electrons within the gas includes directing an electron beam into the chamber from outside of the chamber.

10. Apparatus for forming excimers in a gas comprising:

a chamber for containing an excimer-forming gas;

an electron source associated with the chamber, the electron source being arranged to provide high energy electrons in the gas so that within a region of the chamber a substantial majority of free electrons in the gas have energies equal to or greater than the excitation energy required to form the excimers and so that in a further region of the chamber few or no free electrons with energy equal to or greater than said excitation energy are present; and a phosphor disposed within the chamber and within the further region of the chamber.

11. An apparatus for forming excimers in a gas comprising:

a chamber for containing an excimer-forming gas;

an electron source associated with the chamber, the electron source being arranged to provide high energy electrons in the gas so that within a region of the chamber a substantial majority of free electrons in the gas have energies equal to or greater than the excitation energy required to form the excimers and so that in a further region of the chamber few or no free electrons with energy equal to or greater than said excitation energy are present; and a phosphor disposed within the chamber and within the further region of the chamber.

12. The apparatus of claim 11 wherein the chamber has a wall at least partially transmissive to the light.

13. The apparatus of claim 11, wherein the gas includes a first gas component selected from the group consisting of He, Ne, Ar, Kr, and Xe and mixtures there of.

14. Apparatus as claimed in claim 10 wherein the electron source includes:

(a) a first electrode disposed within said chamber in contact with the gas;

(b) a counter electrode within said chamber in contact with the gas remote from said first electrode; and (c) a potential-applying circuit connected to said first electrode and to said counter electrode, said circuit being adapted to apply a potential between said electrodes so that the potential imposes an electric field within said gas, wherein said electric field is configured so that (i) within a region of said field said free electrons have an electron energy distribution such that at least some free electrons have energies equal to or greater than the excitation energy required to form the excimer; and (ii) said free electrons have an electron energy distribution such that a substantial majority of free electrons have energies less than the ionization energy of the gas, and wherein the first electrode and the counter electrode define a field space within the chamber and the phosphor is disposed outside of the field space.

15. The apparatus of claim 14, wherein said first electrode includes a tip of wire, wherein said counter electrode is a ring with radius between about 0.5 cm and 5 cm, and wherein a distance between the center of the counter electrode and the tip of first electrode is between about 0 to 10 cm.

16. The apparatus of claim 14, wherein said first electrode includes a tip of a wire and said counter electrode at least partially surrounds the tip.

17. The apparatus of claim 14, wherein the first electrode includes a tip of wire and at least part of the counter electrode is a surface equidistant from said tip of wire.

18. The apparatus of claim 14, wherein the first electrode includes carbon nanotube electron emitters.

19. The apparatus of claim 14, wherein said first electrode is an elongated wire defining an axis of elongation, and wherein said at least part of said counter electrode is in the form of at least a portion of a surface of revolution about said axis of elongation.

20. The apparatus of claim 14, wherein the electric potential is pulsed and includes pulses about 100 microseconds or less in duration.

21. The apparatus of claim 10 wherein the electron source includes an electron beam gun disposed outside the chamber and arranged to direct a electron beam into the chamber.

22. The apparatus of claim 21 wherein the chamber has a foil window including silicon and the electron beam gun is arranged to direct electrons at about 5 to 40 KeV into said chamber through said foil window.

* * * * *